US006416282B1

(12) United States Patent
Beeck et al.

(10) Patent No.: US 6,416,282 B1
(45) Date of Patent: Jul. 9, 2002

(54) ROTOR FOR A GAS TURBINE

(75) Inventors: Alexander Beeck, Küssaberg; Herbert Brandl, Waldshut-Tiengen; Hartmut Haehnle, Küssaberg, all of (DE); Beat von Arx, Trimbach (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/686,963

(22) Filed: Oct. 12, 2000

(30) Foreign Application Priority Data

Oct. 18, 1999 (DE) ..... 199 50 109

(51) Int. Cl.[7] ..... F01D 5/18

(52) U.S. Cl. ..... 416/97 R; 416/95; 416/96 R; 416/193 A; 416/219 R; 415/115

(58) Field of Search ..... 416/96 R, 97 R, 416/92, 95, 193 A, 193 R, 219, 220 R; 415/115, 116

(56) References Cited

U.S. PATENT DOCUMENTS

| | | | | |
|---|---|---|---|---|
| 2,858,103 A | * | 10/1958 | Waugh | 416/97 R |
| 2,873,947 A | * | 2/1959 | Perry | 416/220 R |
| 3,266,770 A | * | 8/1966 | Harlow | 416/97 R |
| 3,318,573 A | * | 5/1967 | Matsuki et al. | 416/91 |
| 4,523,890 A | | 6/1985 | Thompson | 416/95 |
| 5,415,526 A | | 5/1995 | Mercadante et al. | 416/193 A |
| 5,630,703 A | * | 5/1997 | Hendley et al. | 416/95 |
| 5,639,216 A | | 6/1997 | McLaurin et al. | 416/95 |

FOREIGN PATENT DOCUMENTS

| | | |
|---|---|---|
| DE | 971 297 | 1/1959 |
| DE | 26 39 511 | 3/1977 |
| EP | 0 043 300 | 1/1982 |

* cited by examiner

*Primary Examiner*—Edward K. Look
*Assistant Examiner*—Richard Woo
(74) *Attorney, Agent, or Firm*—Burns, Doane, Swecker & Mathis, L.L.P.

(57) ABSTRACT

A rotor for a gas turbine comprises a multiplicity of rotor blades of which each comprises a blade airfoil, a blade root and a platform arranged between blade airfoil and blade root and each of which, together with the blade root, is pushed into an axial location slot, which is arranged on the outer periphery of a rotor disk, and is releasably retained there in such a way that hollow spaces are formed between the platform and the peripheral surface of the rotor disk, and each of which is supplied, for cooling purposes, with cooling air through at least one cooling air supply passage extending in the rotor disk and emerging into the location slot, which cooling air is fed through the blade root to within the blade airfoil.

12 Claims, 5 Drawing Sheets

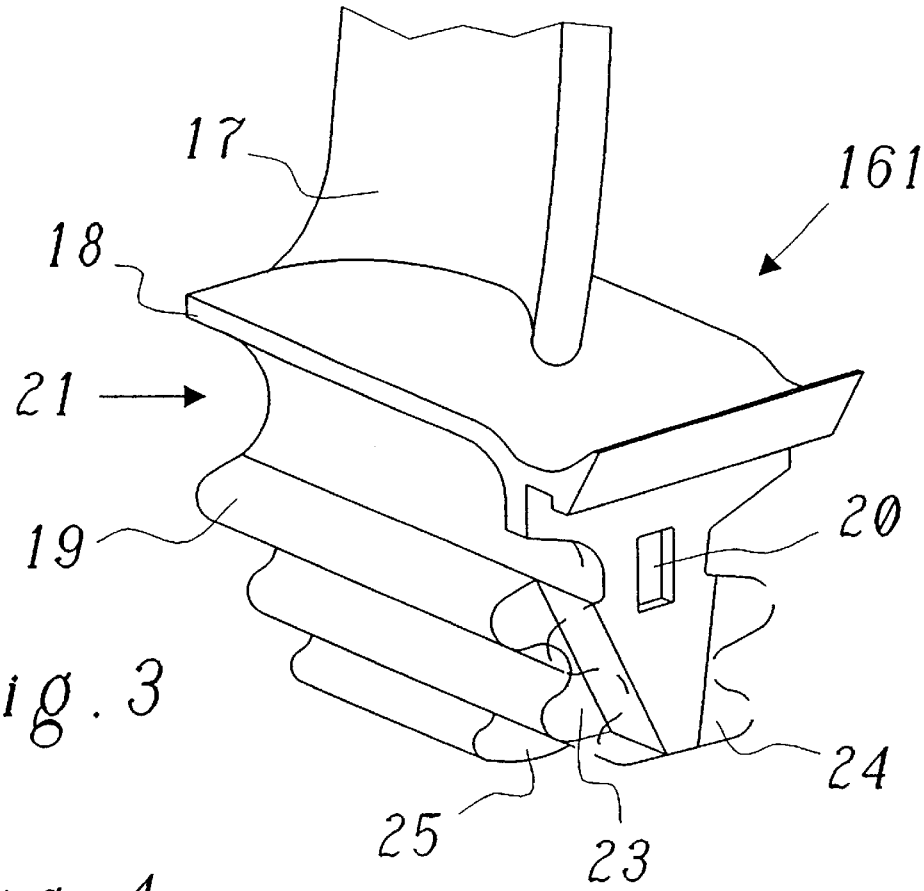
Fig. 3
Fig. 4
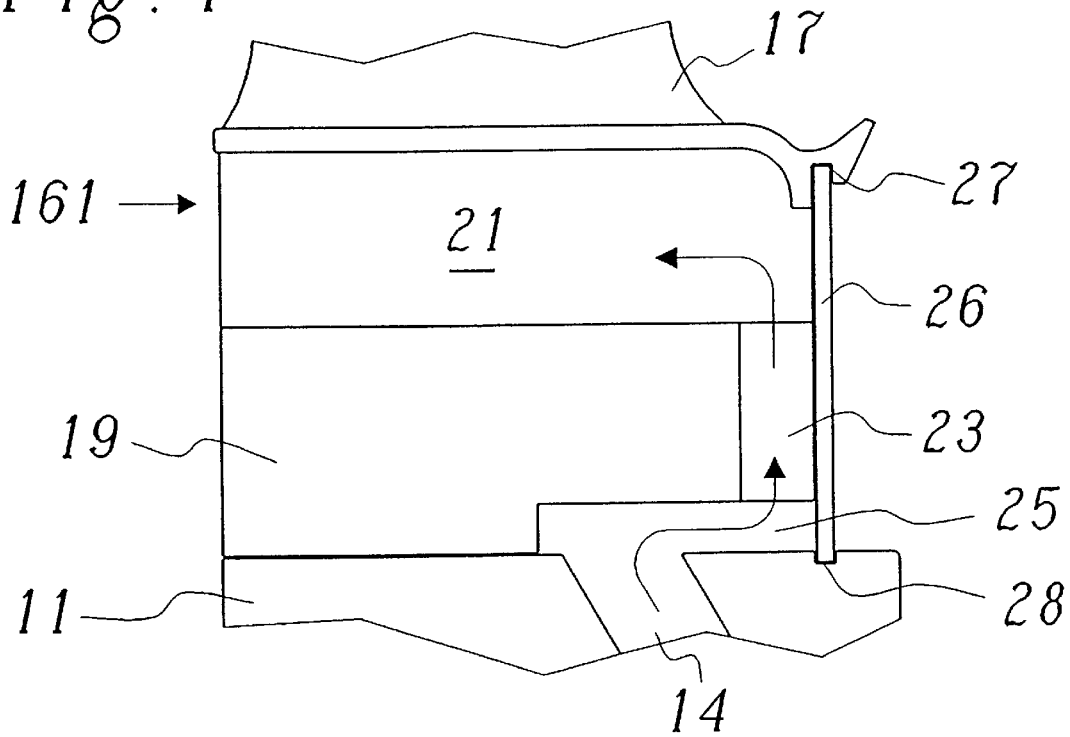

ROTOR FOR A GAS TURBINE

This application claims priority under 35 U.S.C. §§119 and/or 365 to Appln. No. 199 50 109,2 filed in Germany on Oct. 18, 1999; the entire content of which is hereby incorporated by reference

FIELD OF THE INVENTION

The present invention relates to a rotor for a gas turbine, and more particularly to cooling rotor blades.

BACKGROUND OF THE INVENTION

An example of a rotor having a cooling arrangement is disclosed in U.S. Pat. No. 4,505,640 and is illustrated in FIG. 1. The rotor 10 comprises a rotor disk 11 at whose periphery are arranged a multiplicity of location slots 13 essentially extending in the axial direction and separated from one another by rotor teeth 12. Cooling air supply passages 14, which extend in the rotor disk 11 and provide cooling air for cooling the rotor blades 16, emerge from below into the location slots 13. The rotor blades 16, which each have a blade airfoil 17, a blade root 19 and a platform 18 which is arranged above the blade root 19, are pushed—together with the blade root 19—in the axial direction into the location slot 13 and are there releasably retained, a positive connection being usually achieved by means of a fir-tree configuration of the cross-sectional profile. Hollow spaces 21 are formed between the platforms 18 and the peripheral surface 15, which is located underneath, of the rotor disk 11. The cooling air (or another suitable cooling medium) introduced by means of the cooling air supply passage 14 is fed through ducts (not shown) within the blade root 19 to the inside of the (hollow) blade airfoil 17, where it flows and is then allowed to escape through outlet openings on the blade airfoil 17 and/or on the platform 18.

In the rotor blade 16, it is necessary (for reasons of thermal load-carrying capability) for the cooling medium to cool not only the actual blade airfoil, by means of the cooling medium flowing within it, but also to cool the blade root 19 and the platform 18 arranged above the blade root.

In the past, a multiplicity of proposals have been made for cooling these partial regions of the rotor blade.

In U.S. Pat. Nos. 4,012,167, 5,639,216 and 5,848,876, for example, it is proposed that horizontally extending cooling air ducts should be accommodated within the platform, these being supplied with cooling air in various ways. Such internal cooling of the platform is, however, very complicated from the point of view of manufacturing technology because it is difficult to create appropriate ducts in, for example, cast blades.

U.S. Pat. No. 5,800,124, furthermore, proposes the configuration of cover plates laterally arranged in the root region in such a way that cooling air is blown from below onto the rear edge of the blade platform through corresponding vertical ducts in the cover plates. Cooling of the complete platform is not possible by this means.

U.S. Pat. No. 5,738,489 proposes attaching, to the bottom of the platforms, a thermal conductor which removes the heat from the platform and conveys it to the central cooling air duct in the blade root. Such a solution is likewise complicated from a manufacturing technology point of view because, in this case, special materials must be additionally attached to the blade. Furthermore, it is not possible to flush the hollow spaces below the platform with cooling air in this way.

Finally, U.S. Pat. No. 5,340,278 proposes the provision of holes extending obliquely downward at the level of the platform, cooling air from the central cooling air duct of the blade being blown through these holes into the hollow spaces below the platform. Although this does permit the platform to be cooled and the hollow spaces to be flushed, the holes are likewise very complicated to manufacture.

In rotor blades which are fed with cooling air from the rotor end, furthermore, it is usual to employ the cooling air which flows past the fastening for cooling the platform or at least for flushing the hollow spaces. The quantity of cooling air is indeterminate because it depends on the fit between the blade root and the location slot and is more equivalent to a leakage.

SUMMARY OF THE INVENTION

The object of the invention is, therefore, to create a rotor in which, in a simple manner from the point of view of manufacturing technology, cooling medium or cooling air can be brought in a defined quantity from the rotor-end cooling air supply passage into the hollow spaces below the platform.

The invention achieves this object by forming cooling air ducts between the outside of the blade root and the inside of the location slot, which cooling air ducts can be simply manufactured, for example as recesses, and guide the cooling medium on a direct path from the cooling air supply passage into the hollow spaces.

A preferred embodiment of the rotor in accordance with the invention is characterized in that the cooling air ducts are at least partially configured as recesses in the blade root and/or location slot. These recesses can be formed directly, in a particularly simple manner, during casting or they can be manufactured by subsequent material removal.

This is particularly simple if, in accordance with a preferred development of this embodiment, the cooling air ducts are configured as recesses which extend vertically between the outlet of the cooling air supply passage and the hollow spaces.

Another preferred development is characterized in that the cooling air ducts are configured as recesses which, on the one hand, extend horizontally outward from the outlet of the cooling air supply passage to an end surface of the blade root end, on the other hand, extend vertically upward on the end surface and into the hollow spaces, and in that the end-surface recesses are sealed toward the outside by cover plates, in that axial locking plates, which are arranged at the end surface, are provided to secure the rotor blades axially in the location slots, and in that the axial locking plates are employed as cover plates.

A further preferred development is distinguished by the fact that a cooling air duct is configured as a recess which leads horizontally outward from the outlet of the cooling air supply passage to an end surface of the blade root, in that an axial locking plate, which is arranged at the end surface, is provided to secure the rotor blade axially in the location slot, and in that the axial locking plate is shaped in such a way that a cooling air duct is formed which extends vertically upward between the axial locking plate and the end surface of the blade root and into the hollow spaces. The formation of the cooling air ducts can, in this way, be effected at least partially by a comparatively simple shaping of the axial locking plates.

DESCRIPTION OF THE DRAWINGS

The invention is described in more detail below in association with the drawings, in which:

FIG. 3 is a perspective side view of a rotor blade with additional horizontally and vertically extending cooling air ducts formed on the blade root, in accordance with a second embodiment of the invention, FIG. 4 is a cross-sectional view of the rotor blade of FIG. 3 inserted in the rotor disk, with an axial locking plate being employed to form the vertical cooling air ducts;

DETAILED DESCRIPTION OF THE INVENTION

Figure 1:
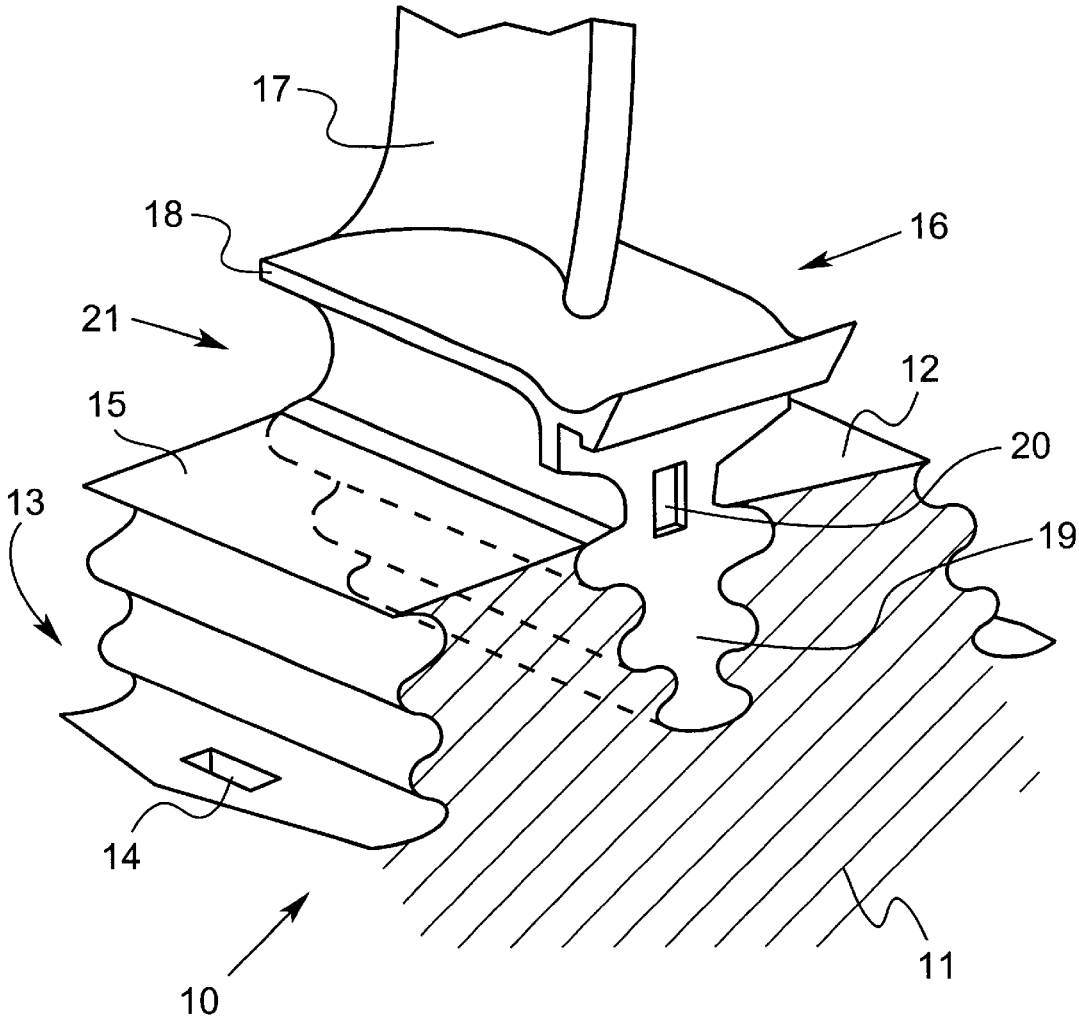
PRIOR ART FIG 1.
FIG. 1 is a perspective side view of a rotor disk with inserted, cooled rotor blades of the prior art.
Figure 2:
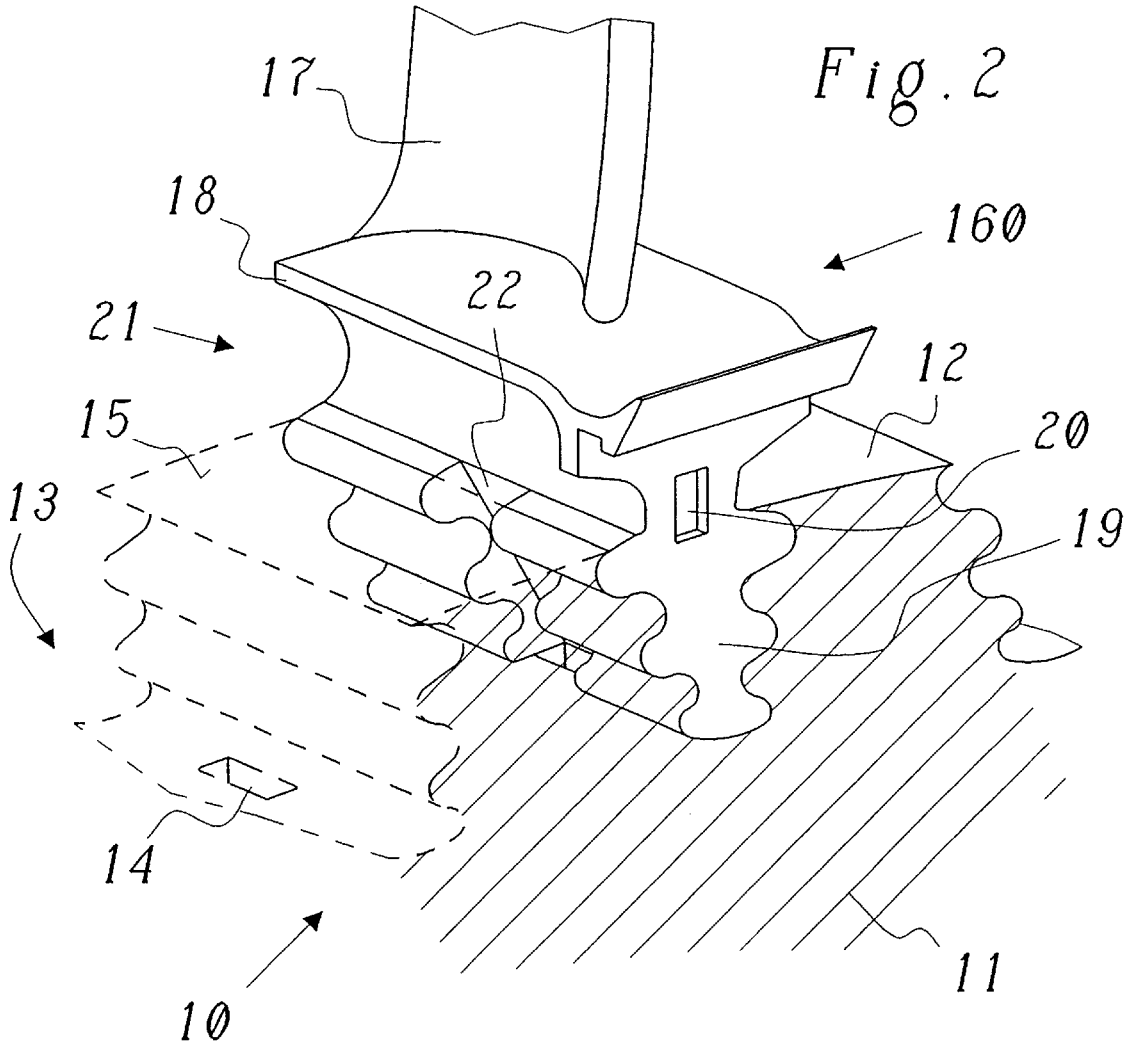
FIG. 2 is a perspective side view of a rotor with additional vertical cooling air ducts in accordance with a first embodiment of the invention.
Figure 5:
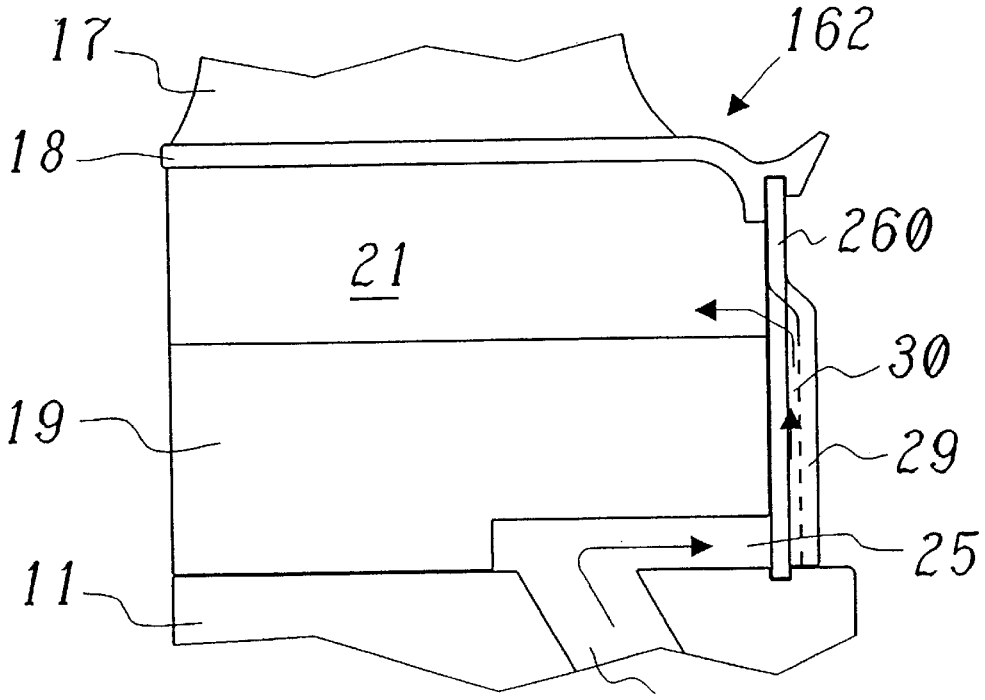
FIG. 5 is a cross-sectional view as in FIG. 4, in a first modified form of the invention, in which the vertical cooling air ducts are created by crimps formed in the axial locking plate.
Figure 6:
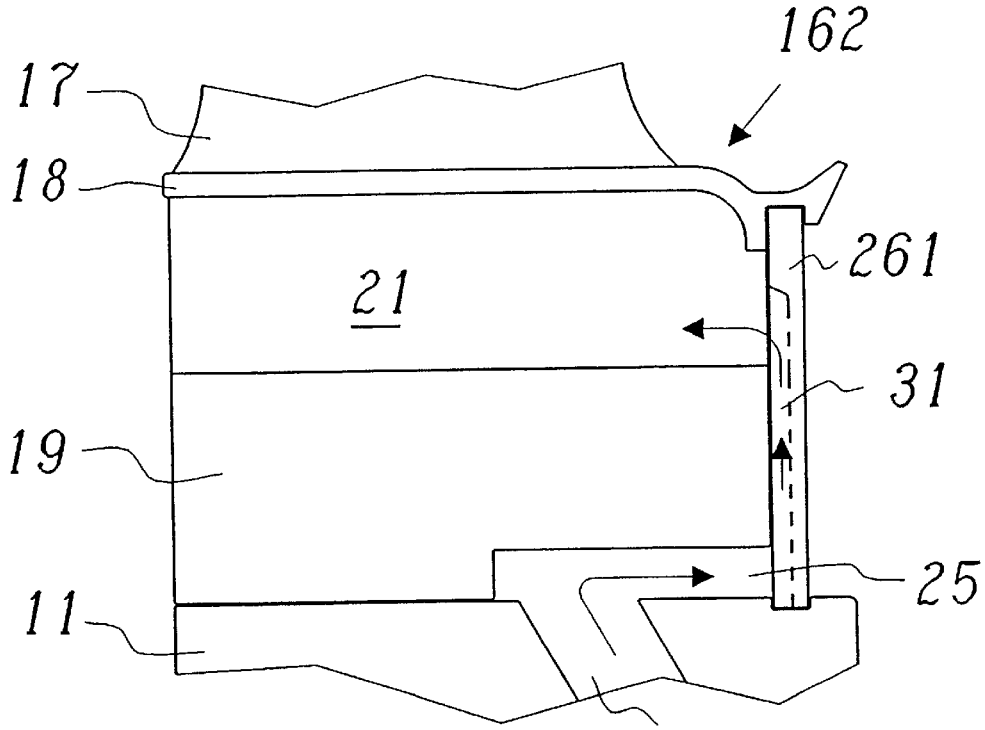
FIG. 6 is a cross-sectional view as in FIG. 4, in a second modified form of the invention, in which the vertical cooling air ducts are formed by flat recesses in the axial locking plate.
Figure 7:
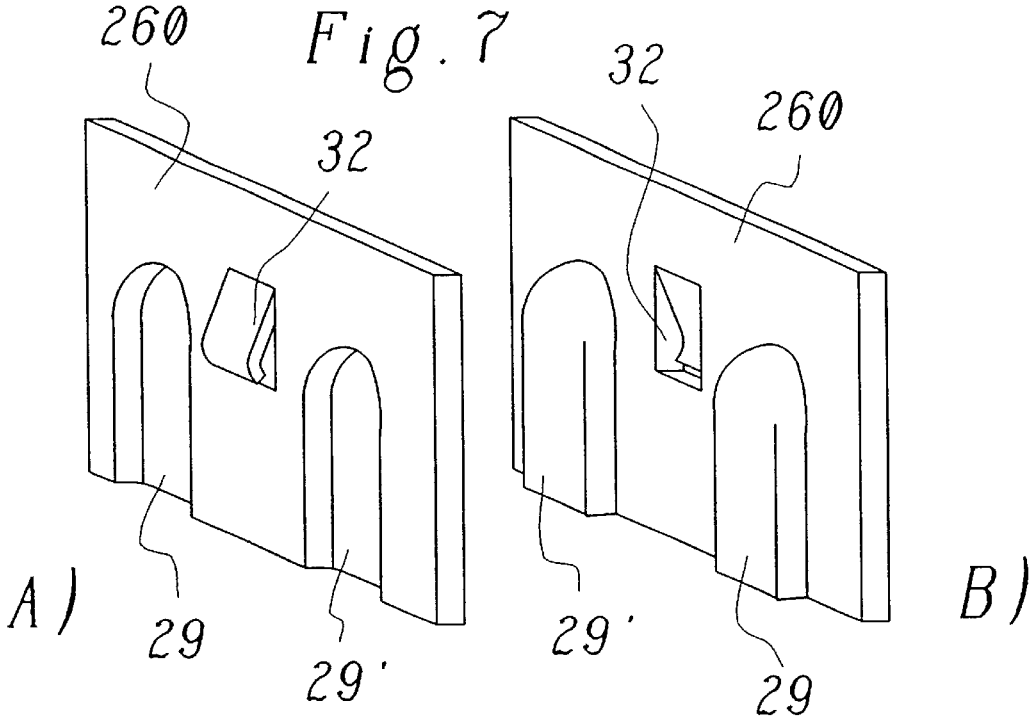
FIG. 7 is a perspective side view from the front (partial figure A) and the back (partial figure B), of the axial locking plate of FIG. 5.
Figure 8:
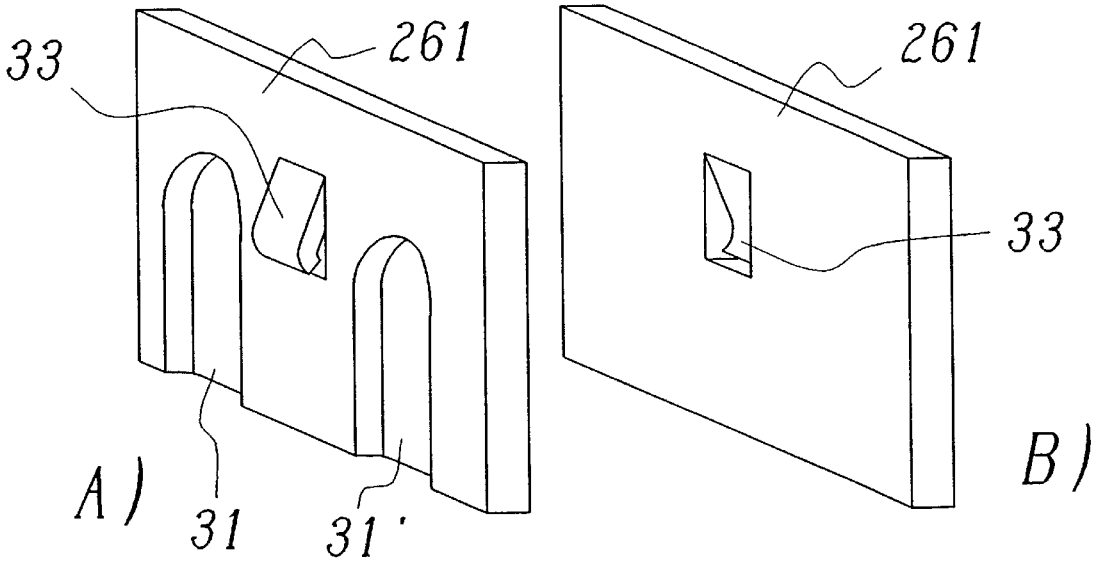
FIG. 8 is a perspective side view from the front (partial figure A) and the back (partial figure B), of the axial locking plate of FIG. 6.

FIG. 2 shows, in a representation comparable with FIG. 1, a rotor with additional vertical cooling air ducts in accordance with a first embodiment of the invention. Similar parts are provided with the same designations as those in FIG. 1. The hollow spaces 21 below the platform 18 are, in this case, directly supplied with cooling air by means of vertical cooling air ducts 22. The cooling air ducts 22 extend directly from the outlet of the cooling air supply passage 14 at the bottom of the location slot 13 to the hollow space 21 and flush the hollow space 21 with cooling air and, at the same time, cool the bottom of the platform 18. The cooling air ducts 22 are located in the central vertical plane of the rotor blade 160 and are formed by recesses in the blade root 19, which recesses are either formed during the casting of the rotor blade 160 or are created later by material removal (for example by milling). In this arrangement, the cross section of the cooling air ducts 22 is designed in accordance with the required cooling air quantity.

Another arrangement in accordance with the invention, of forming cooling air ducts on the blade root by appropriate recesses is shown in FIGS. 3 and 4. In the case of the rotor blade 161 of FIG. 3, vertically extending cooling air ducts 23, 24 are kept free at one end surface of the blade root 19 by means of undercuts, the cooling air being brought up from below into the hollow spaces 21 through these cooling air ducts 23, 24. An axial locking plate 26 inserted in corresponding grooves 27, 28 to secure the rotor blade 161 axially is used as the outer limit of the cooling air ducts 23, 24. A further horizontal cooling air duct 25, which is formed by an undercut or recess on the bottom of the blade root 19, is provided for connecting the vertical cooling air ducts 23, 24 to the outlet of the cooling air supply passage 14. The cooling air then flows, as shown by the arrows in FIG. 4, out of the cooling air supply passage 14 and upward via the cooling air ducts 25 and 23 or 24 into the hollow spaces 21 below the platform 18.

However, it is naturally also conceivable to retain the blade root in the form shown in FIG. 1 and to form the additional cooling air ducts by complementary undercuts or recesses in the location slots 13 of the rotor disk 11.

Another way of forming the cooling air ducts, in accordance with the invention, in the region of the blade root 19 is represented in FIGS. 5 to 8. Here again—as in the embodiment example of FIG. 3—the vertical cooling air ducts are arranged on an end surface of the blade root 19 and are connected to the cooling air supply passage 14 by means of a vertical cooling air duct 25. As a departure from FIG. 3, however, the recesses necessary for this purpose are not provided on the blade root 19 itself but on an axial locking plate 260 or 261 employed to secure the rotor blade 162 axially on the end surface. In the case of the axial locking plate 260 of FIG. 5 or FIG. 7, the vertical cooling air ducts 30 are formed by crimps 29 and 29' formed in the axial locking plate (one of the crimps is associated with each blade root). In the axial locking plate 261 of FIG. 6 or FIG. 8, the vertical cooling air ducts are formed by recesses 31 and 31' located in the (thicker) axial locking plate. A locking tab 32 or 33, by means of which the locking plate engages in a locking groove 20 on the blade root 19 (FIG. 1–3) for purposes of peripheral locking, can be provided in each case between the crimps 29, 29' or recesses 31, 31'. In this type of duct path, the cooling air flow takes place along the arrows shown in FIGS. 5 and 6.

Overall, the invention results in defined flushing of the hollow spaces below the platforms, in a manner particularly simple to manufacture, by means of which the entry of hot gas is reliably prevented, together with good cooling of the platforms themselves.

What is claimed is:

1. A rotor for a gas turbine comprising: a rotor having a multiplicity of rotor blades of which each includes a blade airfoil, a blade root and a platform arranged between the blade airfoil and the blade root and each of which, together with the blade root, is received in an axial location slot on the outer periphery of a rotor disk, hollow spaces being formed between the platform and the peripheral surface of the rotor disk, each of the rotor disks including at least one cooling air supply passage extending in the rotor disk and emerging into the location slot, which cooling air is fed through the blade root to the interior of the blade airfoil, cooling air ducts, by means of which cooling air is fed from the cooling air supply passage into the hollow spaces, are provided between the outside of the blade root and the inside of the location slot in order to flush the hollow spaces and cool the platform.

2. The rotor as claimed in claim 1, wherein the cooling air ducts are configured as recesses in the blade root.

3. The rotor as claimed in claim 2, wherein the cooling air ducts are configured as recesses, which extend vertically between the outlet of the cooling air supply passage and the hollow space between the outer periphery of the rotor disk and the platform.

4. The rotor as claimed in claim 2, wherein the cooling air ducts are configured as recesses which extend horizontally outward from the outlet of the cooling air supply passage to an end surface of the blade root and extend vertically upward on the end surface and into the hollow spaces, and in that the end-surface recesses are sealed toward the outside by cover plates.

5. The rotor as claimed in claim 4, wherein axial locking plates are arranged at the end surface, are provided to secure the rotor blades axially in the location slots, and in that the axial locking plates are cover plates.

6. The rotor as claimed in claim 2, wherein a cooling air duct includes a recess which leads horizontally outward from the outlet of the cooling air supply passage to an end surface of the blade root, an axial locking plate, which is arranged at the end surface, is provided to secure the rotor blade axially in the location slot, and in that the axial locking plate is shaped in such a way that a cooling air duct is formed which extends vertically upward between the axial locking plate and the end surface of the blade root and into the hollow spaces.

7. The rotor as claimed in claim 6, wherein crimps are formed in the axial locking plate in order to create the vertical cooling air ducts.

8. The rotor as claimed in claim 6, wherein recesses are provided in the axial locking plate in order to create the vertical cooling air ducts.

9. The rotor as claimed in claim 1, wherein the cooling air ducts are configured as recesses in the location slot.

10. A rotor assembly for a gas turbine comprising a rotor on the periphery of which a plurality of blades are mounted, the blades include a blade root and a blade airfoil and a blade platform between the root and airfoil, the blade root being secured in a slot in the rotor, a passage for conducting cooling air to an outlet in the slot, the blade root having a cooling air duct extending from the outlet to the exterior of the blade between the blade platform and the blade root.

11. The rotor assembly as claimed in claim 10, wherein the assembly includes a locking plate secured between the rotor and the blade platform, and the cooling air duct extending adjacent the locking plate.

12. The rotor assembly as claimed in claim 11, wherein the locking plate has at least one crimp that forms at least part of the cooling air duct.

* * * * *